US005720227A

United States Patent [19]

Baker et al.

[11] Patent Number: 5,720,227

[45] Date of Patent: Feb. 24, 1998

[54] METHOD OF CONSTRUCTION FOR A PALLET

[76] Inventors: Patrick Dennis Baker, 80 Ravensdale Rise, Westmoreland, Christchurch 8002; Roderick Shearer, 2 Chain Road, No. 5 R.D., Christchurch, both of New Zealand

[21] Appl. No.: 319,806

[22] Filed: Oct. 7, 1994

[30] Foreign Application Priority Data

Aug. 8, 1994 [NZ] New Zealand ..... 264198

[51] Int. Cl.[6] ..... B65D 19/38

[52] U.S. Cl. ..... 108/53.3; 108/55.3; 108/901

[58] Field of Search ..... 108/51.1, 52.1, 108/901, 902, 53.1, 53.3, 56.3

[56] References Cited

U.S. PATENT DOCUMENTS

| | | | |
|---|---|---|---|
| 3,610,172 | 10/1971 | Wharton | 108/51 |
| 3,804,032 | 4/1974 | Baucom | 108/51 |
| 4,279,204 | 7/1981 | Propst | 108/53.3 |
| 4,390,154 | 6/1983 | Ostler et al. | 248/346 |
| 4,425,852 | 1/1984 | Riviere | 108/56.3 |
| 4,671,188 | 6/1987 | Betro et al. | 108/56.3 |
| 4,850,284 | 7/1989 | DeGroot et al. | 108/56.3 |
| 4,966,084 | 10/1990 | Motomaru | 108/51.3 |
| 5,193,464 | 3/1993 | Morden | 108/56.3 |
| 5,289,781 | 3/1994 | Beckway | 108/51.3 |

*Primary Examiner*—James R. Brittain
*Assistant Examiner*—Gerald A. Anderson
*Attorney, Agent, or Firm*—Tobor & Goldstein, L.L.P.

[57] ABSTRACT

A pallet which includes a series of stackable feet orientated in relation to a platform. The platform is formed from at least two sheets of a fluted plastics material. The sheets of plastics material flutes are orientated so that the longitudinal axes of the flutes are at right angles to each other. The sheets of plastics material are joined together by any suitable means such as an adhesive or by the side edges of the sheets being welded together. The pallet can be constructed by a method including the steps of:

forming in at least two sheets of fluted plastics material a series of holes orientated so that when the sheets are laid on top of each other the longitudinal axes of the flutes are at right angles to each other;

placing the sheets of fluted plastics material in the desired orientation;

joining the sheets of plastics material together to form a laminate platform by either fixing them together or welding the edges of the sheets together;

placing in the aligned holes stackable feet members and fixing them in position.

The fluted plastics sheet can be constructed from polyethylene.

9 Claims, 2 Drawing Sheets

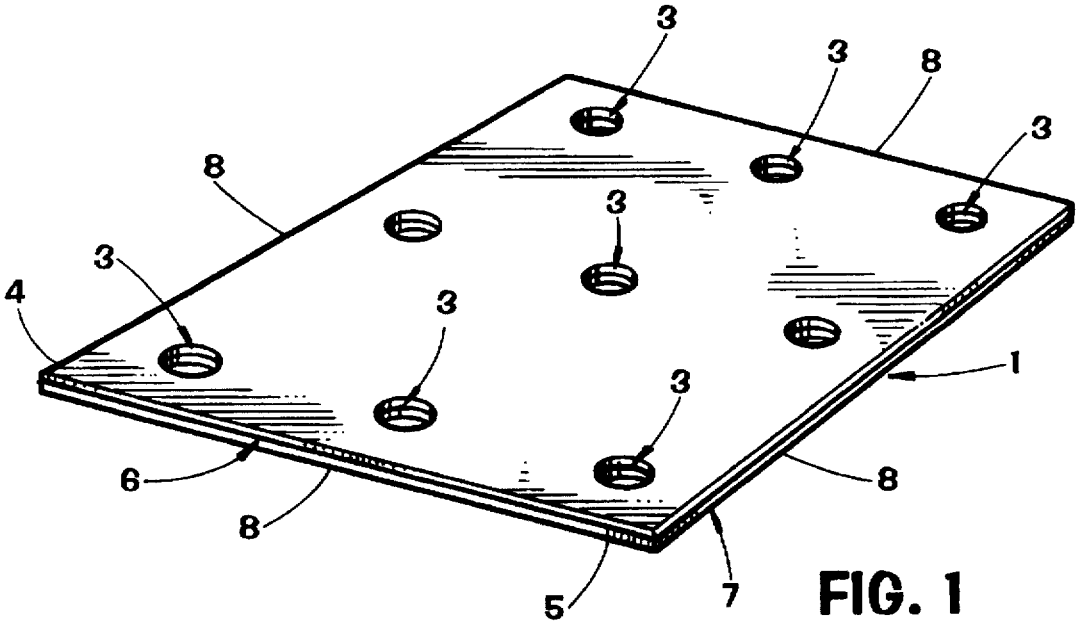
FIG. 1
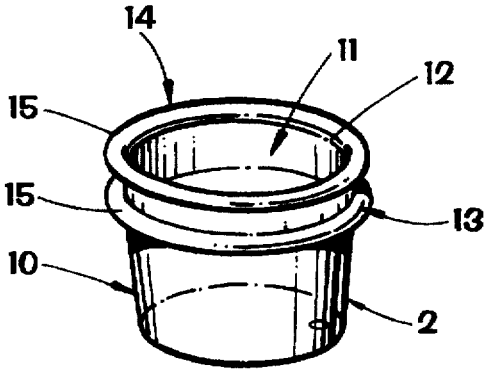
FIG. 2
FIG. 3
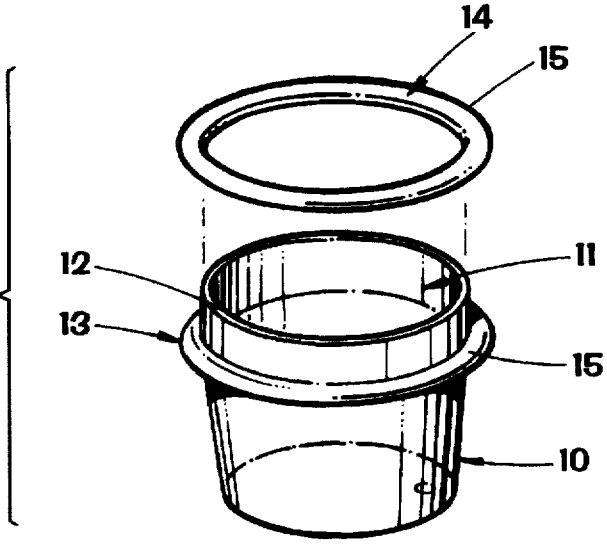

METHOD OF CONSTRUCTION FOR A PALLET

FIELD OF THE INVENTION

The invention relates to a pallet and particularly to a method of construction for a pallet.

BACKGROUND OF THE INVENTION

At present a number of constructions of pallet are available, however not many of these are easily stackable for storage when empty.

An object of the invention is to provide a lightweight stackable pallet which when a series are stacked on each other take up a small space.

Further objects and advantages of the invention will become apparent from the following description which is given by way of example only.

SUMMARY OF THE INVENTION

According to a first aspect of the invention there is provided a pallet including a series of stackable feet orientated in relation to a platform, the platform being formed from at least two sheets of a fluted plastics material, the sheets of plastics material being orientated so that the longitudinal axes of the flutes are at right angles to each other.

The sheets of plastics material are joined together by any suitable means such as an adhesive or by the side edges of the sheets being welded together.

According to a second aspect of the invention there is provided a method of constructing a pallet, the method including the steps of:

- forming in at least two sheets of fluted plastics material a series of holes orientated so that when the sheets are laid on top of each other the longitudinal axes of the flutes are at right angles to each other;
- placing the sheets of fluted plastics material in the desired orientation;
- joining the sheets of plastics material together to form a laminate platform by either fixing them together or welding the edges of the sheets together;
- placing in the aligned holes stackable feet members and fixing them in position.

The fluted plastics sheet can be constructed from polyethylene.

According to a third aspect of the invention there is provided a racking system for pallets as hereinbefore defined, the rack including a series of extruded, cast, formed or fabricated members provided with holes positioned so that the feet of the pallets fits within the members to thereby provide support to the surface of the sheet of plastics material to carry whatever load is placed on the pallet.

The series of members can be constructed from an extrudable material such as aluminium or reinforced plastics material.

Further aspects of the invention which should be considered in all its novel aspects will become apparent from the following descriptions which is given by way of example only.

DESCRIPTION OF THE DRAWINGS

FIG. 1 shows a diagrammatic isometric view of a pallet according to the invention.

FIG. 2 shows a perspective view from above of a foot member for the pallet.

FIG. 3 shows a view of the foot member shown in FIG. 2 with its two parts exploded apart.

DESCRIPTION OF THE PREFERRED EMBODIMENT

Figure 4:
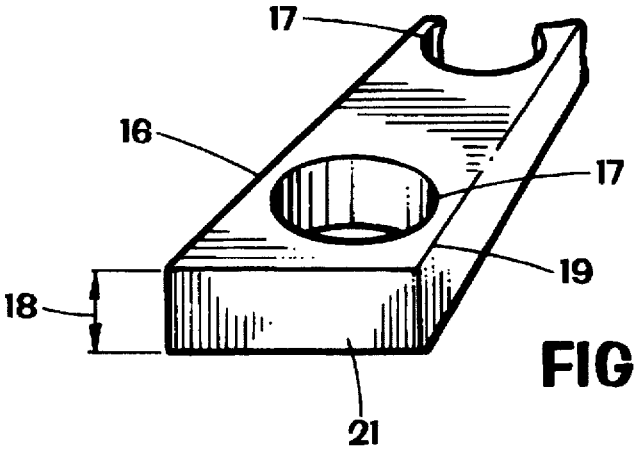
FIG. 4 shows an end view of an example of metal extrusion member according to the third aspect of the invention.

The embodiment of the invention will be described with reference to a pallet formed using feet. In the embodiment the pallet 1 is about one meter square and is provided with nine similar feet 2. It is to be appreciated that the overall size of the pallet and the number of feet can vary depending on the particular use for which the pallet is constructed.

The feet 2 are fitted in aligned holes 3 in the platform of the pallet 1.

The platform 1 of the pallet 1 is formed from at least two sheets 4,5 of fluted plastics material. Preferably the plastics material is a fluted polyethylene sheet.

The two sheets 4,5 are orientated with the longitudinal axes of the flutes 6,7 at right angles to each other.

The fluted sheets 4,5 are joined together either using adhesive or by welding the side edges 8 of the sheets together. If this construction is adopted the side edges 8 are, during the welding operation, formed into a rounded edge which provides both strength and a neat edge to the pallet.

Each of the aligned holes 3 has fitted therein a foot 10 of the type shown in FIG. 2.

The foot 10 can be an injection moulded plastics fitting formed with a tapered recess 11 in its upper surface 12. The foot 10 is formed in two parts 13,14 which clip together. Each part has a ledge 15 which when the parts are snap fitted together surrounds the open edges of the holes 3 in the platform of pallet 1. These feet hold the sheets 4,5 together and provide additional support over and above the weld joints around the peripheral edge. As an alternative to a clipping action the parts of the foot 10 can be fixed together in other ways such as being soldered or glued together.

In use the pallet can be used in the usual way with a series of boxes or other items stacked on the platform of pallet 1. An advantage is that when the pallet 1 is not in use the feet 10 are provided with recesses 11 which means that the pallets when stacked on top of each other only occupy a small space.

Figure 5:
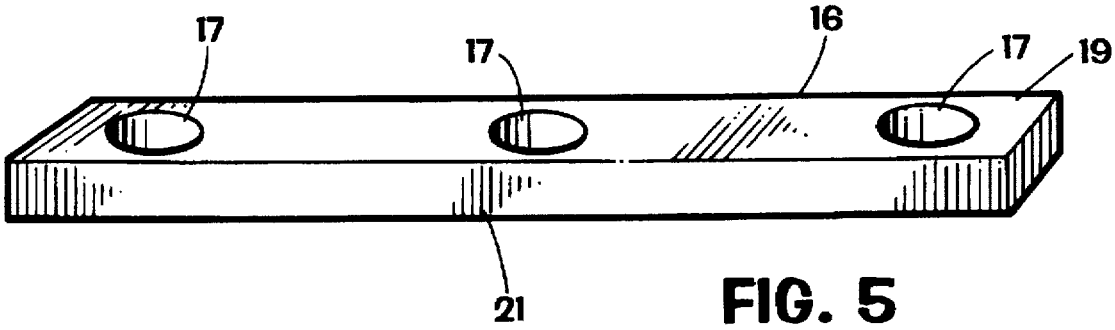
FIG. 5 shows a side view of the extrusion member shown in FIG. 4.
Figure 6:
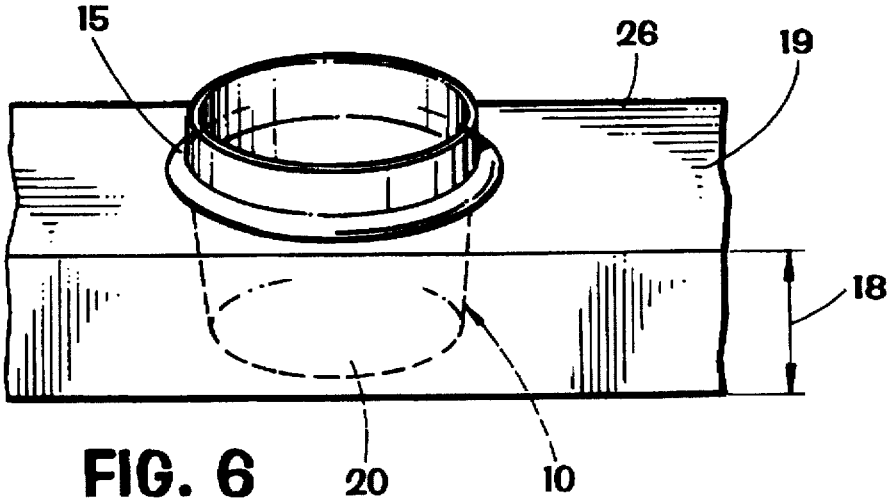
FIG. 6 shows, on enlarged scale, a connection between a foot of a pallet and one of the holes formed in the extrusion shown in FIGS. 4 and 5.

FIGS. 4 to 6 is shown part of a racking system on which a pallet as defined hereinbefore is stored or transported. The racking system includes a series of extrusion members 16 with holes 17 positioned so that the spaced apart feet 10 of a pallet 1 fits therein. The depth 18 of the extrusion member 16 is the height of the feet 10. As shown in FIG. 6 the ledge 15 sits on the top 10 of the extrusion member 16 and the lower surface of the lower sheet 4 rests on the top 19 to thereby spread any load on the sheets 4,5 over the extrusion. The bottom 20 of the foot 10 rests on the bottom surface 21 of the extrusion.

In use a series of the extrusions are position on or as a rack on which the pallets are stacked. Any load on the pallet is thereby carried by this extrusion lessening the risk of damage to the pallet and increasing its load bearing characteristics.

Thus by this invention there is provided a lightweight stackable pallet which when a series are stacked on each other take up a small space.

Particular embodiments of the invention have been described and it is envisaged that improvements and modifications can take place without departing from the scope and spirit of the appended claims.

What we do claim and desire to obtain by Letters Patent the United States is:

1. A stackable pallet, comprising:

a first rectangular, planar sheet of a plastic material having an upper and a lower wall and a plurality of side edges, including a plurality of first flutes disposed on the lower wall surface of the first sheet, each of the first flutes having a longitudinal axis, the longitudinal axes of all the first flutes being disposed substantially parallel to each other;

a second rectangular, planar sheet of a plastic material having an upper and a lower wall surface and a plurality of side edges, including a plurality of second flutes disposed on the lower wall surface of the second sheet each of the second flutes having a longitudinal axis, the longitudinal axes of all the second flutes being disposed substantially parallel to each other;

the first and second planar sheets being joined together with the first and second plurality of flutes disposed in an abutting relationship to each other with the longitudinal axes of the first and second plurality of flutes being disposed substantially perpendicular to each other and with the upper wall surfaces of both the first and second sheets facing outwardly;

the side edges of the first and second sheets being aligned and welded with respect to each other including a rounded, sealed, and integral edge surface surrounding the side edge surfaces of the first and second sheets;

a plurality of feet disposed on the upper surface of the second sheet in a spaced relationship with each other, each of the plurality of feet having a substantially circular cross-sectional configuration and extending outwardly away from the upper surface of the second sheet, the plurality of feet being adapted to support the first and second sheets in a spaced relationship from a support surface; and a plurality of openings formed in the upper surface of the first sheet, each opening having a substantially circular cross-sectional configuration and aligned with a foot disposed upon the upper surface of the second sheet, whereby feet from another pallet may be stackably received within the plurality of openings.

2. The stackable pallet of claim 1, wherein the side edges of the first and second sheets are welded with respect to each other by an adhesive.

3. The stackable pallet of claim 1, wherein the side edges of the first and second sheets are welded with respect to each other by a heat weld.

4. The stackable pallet of claim 1, wherein the side edges of the first and second sheets are welded with respect to each other by an ultrasonic weld.

5. The pallet of claim 1, wherein the plastic material is polyethylene.

6. The pallet of claim 1, including a racking system for supporting the first and second rectangular, planar sheets, the racking system having:

a plurality of elongated members, each member containing a plurality of bores extending into the member, the bores positioned within the member to receive the feet.

7. The pallet of claim 6, wherein the plurality of elongated members are constructed from the group consisting of cast material, formed material, fabricated material, and extruded material.

8. The pallet of claim 6, wherein the plurality of elongated members are constructed from extruded aluminum material.

9. The pallet of claim 6, wherein the plurality of elongated members are constructed from a reinforced plastic material.

* * * * *